US007442004B2

(12) United States Patent
Ruthemeyer et al.

(10) Patent No.: US 7,442,004 B2
(45) Date of Patent: Oct. 28, 2008

(54) THERMALLY COMPLIANT C-CLIP

(75) Inventors: Michael Anthony Ruthemeyer, Cincinnati, OH (US); Glenn Herbert Nichols, Mason, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 517 days.

(21) Appl. No.: 11/161,518

(22) Filed: Aug. 6, 2005

(65) Prior Publication Data

US 2007/0031245 A1 Feb. 8, 2007

(51) Int. Cl.
*F01D 11/08* (2006.01)

(52) U.S. Cl. ..... 415/135; 415/173.1

(58) Field of Classification Search ..... 415/134, 415/135, 136, 137, 173.1, 173.3, 174.2, 213.1; 277/647

See application file for complete search history.

(56) References Cited

U.S. PATENT DOCUMENTS 3,860,358 A * 1/1975 Cavicchi et al. ..... 415/173.1
5,099,550 A * 3/1992 Beane et al. ..... 24/555
6,354,795 B1 3/2002 White et al. ..... 415/116
6,361,273 B1 * 3/2002 Eng et al. ..... 415/173.1
2002/0048512 A1 * 4/2002 Olivier Cot et al. ..... 415/173.1

* cited by examiner

*Primary Examiner*—Richard Edgar
(74) *Attorney, Agent, or Firm*—Adams Intellectual Property Law, P.A.; Willaim Scott Andes, Esq.

(57) ABSTRACT

A C-clip for a gas turbine engine includes an arcuate outer arm having a first radius of curvature; an arcuate, inner arm having a second radius of curvature which is substantially greater than the first radius of curvature; and an arcuate extending flange connecting the outer and inner arms. The flange, the outer arm, and the inner arm collectively define a generally C-shaped cross-section. A shroud assembly includes a shroud segment with a mounting flange, and a shroud hanger with an arcuate hook disposed in mating relationship to the mounting flange. An arcuate C-clip having inner and outer arms overlaps the hook and the mounting flange. The shroud segment and the C-clip are subject to thermal expansion at the hot operating condition. A dimension of one of the shroud segment and the C-clip are selected to produce a preselected dimensional relationship therebetween at the hot operating condition.

9 Claims, 6 Drawing Sheets

THERMALLY COMPLIANT C-CLIP

BACKGROUND OF THE INVENTION

This invention relates generally to gas turbine components, and more particularly to turbine shrouds and related hardware.

It is desirable to operate a gas turbine engine at high temperatures for efficiently generating and extracting energy from these gases. Certain components of a gas turbine engine, for example stationary shrouds segments and their supporting structures, are exposed to the heated stream of combustion gases. The shroud is constructed to withstand primary gas flow temperatures, but its supporting structures are not and must be protected therefrom. To do so, a positive pressure difference is maintained between the secondary flowpath and the primary flowpath. This is expressed as a back flow margin or "BFM". A positive BFM ensures that any leakage flow will move from the non-flowpath area to the flowpath and not in the other direction.

In prior art turbine designs, various arcuate features such as the above-mentioned shrouds, retainers (referred to as "C-clips"), and supporting members are designed to have matching circumferential curvatures at their interfaces under cold (i.e. room temperature) assembly conditions. During hot engine operation condition, the shrouds and hangers heat up and expand according to their own temperature responses. Because the shroud temperature is much hotter than the hanger temperature and the shroud segment is sometimes smaller than the hanger segment or ring, the curvature of the shroud segment will expand more and differently from the hanger curvature at the interface under steady state, hot temperature operation conditions. When the engine is at operating conditions, the C-clip expands to allow thermal deformation in the mating hardware. Stress is induced in the C-clip and mating hardware as the thermal deformation increases. The larger the thermal gradients the larger the stress and the higher the risk of part failure and cracking, and the lower the operational life of the C-clip.

Accordingly, there is a need for a shroud and C-clip that can reduce the curvature deviation effects on the C-clip at the hot operation condition, minimizing the risk of adverse impact to the C-clip, shroud, and hanger durability.

BRIEF SUMMARY OF THE INVENTION

The above-mentioned need is met by the present invention, which according to one aspect provides a C-clip for a gas turbine engine, including an arcuate, generally axially-extending outer arm having a first radius of curvature; an arcuate, generally-axially-extending inner arm having a second radius of curvature which is substantially greater than the first radius of curvature; and an arcuate, generally radially-extending flange connecting the outer and inner arms such that the flange, the outer arm, and the inner arm collectively define a member having a generally C-shaped cross-section.

According to another aspect of the invention, a shroud assembly is provided for a gas turbine engine having a temperature at a hot operating condition substantially greater than at a cold assembly condition thereof. The shroud assembly includes: at least one arcuate shroud segment adapted to surround a row of rotating turbine blades, the shroud segment having an arcuate, axially extending mounting flange; a shroud hanger having an arcuate, axially-extending hook disposed in mating relationship to the mounting flange; and an arcuate C-clip having inner and outer arms overlapping the hook and the mounting flange. The shroud segment and the C-clip are subject to thermal expansion at the hot operating condition, and a dimension of one of the shroud segment and the C-clip are selected to produce a preselected dimensional relationship therebetween at the hot operating condition.

According to another aspect of the invention, a method of constructing a shroud assembly for a gas turbine engine includes: providing a shroud hanger having an arcuate, axially-extending hook; providing at least one arcuate shroud segment adapted to surround a row of rotating turbine blades, the shroud segment having an arcuate, axially extending mounting flange having a first cold curvature at an ambient temperature, and a first hot curvature at an operating temperature substantially greater than the ambient temperature, the mounting flange disposed in mating relationship to the hook; providing an arcuate C-clip having inner and outer arms overlapping the hook and the mounting flange, the C-clip having a second cold curvature at the ambient temperature and a second hot curvature at the operating temperature; and selecting the first and second cold curvatures such that the first and second hot curvatures define a preselected dimensional relationship between the shroud segment and the C-clip.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
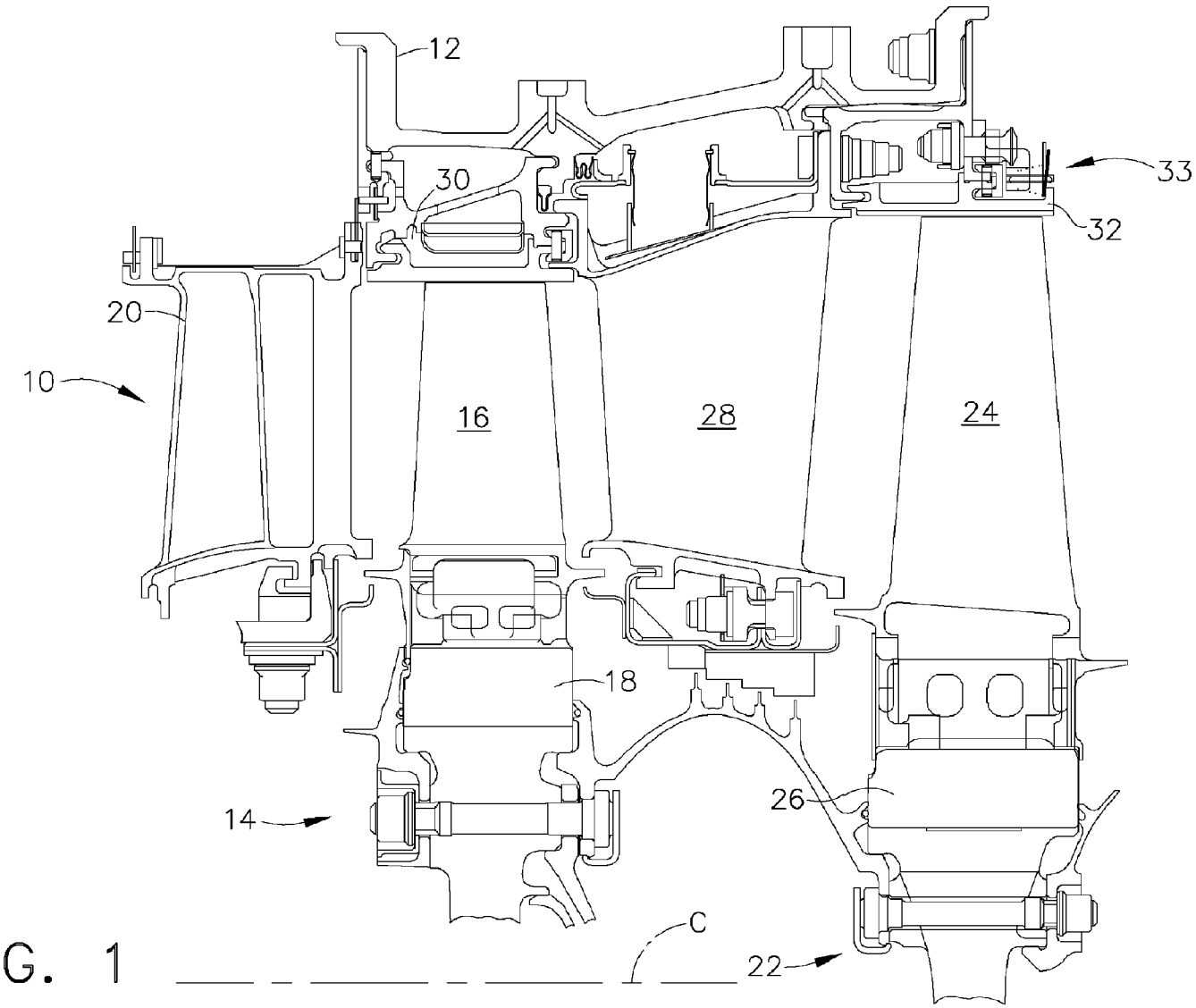
FIG. 1 is a cross-sectional view of an exemplary high-pressure turbine section incorporating the shroud assembly of the present invention.

Referring to the drawings wherein identical reference numerals denote the same elements throughout the various views, FIG. 1 illustrates a portion of a high-pressure pressure turbine (HPT) 10 of a gas turbine engine. the HPT 10 includes a number of turbine stages disposed within an engine casing 12. As shown in FIG. 1, the HPT 10 has two stages, although different numbers of stages are possible. The first turbine stage includes a first stage rotor 14 with a plurality of circumferentially spaced-apart first stage blades 16 extending radially outwardly from a first stage disk 18 that rotates about the centerline axis "C" of the engine, and a stationary first stage turbine nozzle 20 for channeling combustion gases into the first stage rotor 14. The second turbine stage includes a second stage rotor 22 with a plurality of circumferentially spaced-apart second stage blades 24 extending radially outwardly from a second stage disk 26 that rotates about the centerline axis of the engine, and a stationary second stage nozzle 28 for channeling combustion gases into the second stage rotor 22. A plurality of arcuate first stage shroud segments 30 are arranged circumferentially in an annular array so as to closely surround the first stage blades 16 and thereby define the outer radial flowpath boundary for the hot combustion gases flowing through the first stage rotor 14.

A plurality of arcuate second stage shroud segments 32 are arranged circumferentially in an annular array so as to closely surround the second stage blades 24 and thereby define the outer radial flowpath boundary for the hot combustion gases flowing through the second stage rotor 22. The shroud segments 32 and their supporting hardware are referred to herein as a "shroud assembly" 33. Although the invention is described herein with respect to the second stage of the HPT 10, it should be noted that the invention is equally applicable to the first stage of the HPT 10.

Figure 2:
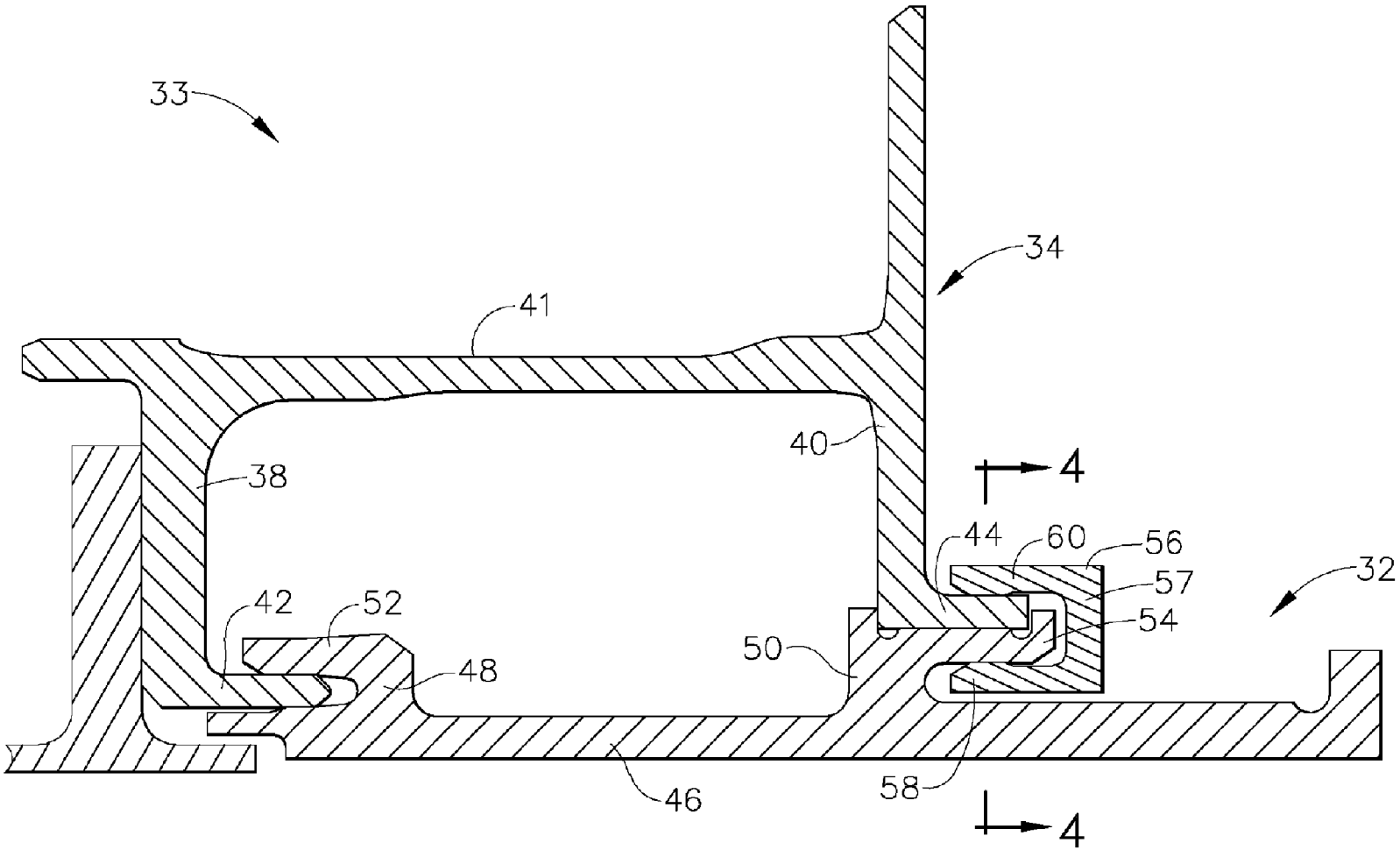
FIG. 2 is an enlarged view of a portion of the turbine section of FIG. 1.

FIG. 2 illustrates the prior art shroud assembly 33 in more detail. A supporting structure referred to as a "shroud hanger" 34 is mounted to the engine casing 12 (see FIG. 1) and retains the second stage shroud segment 32 to the casing 12. The shroud hanger 34 is generally arcuate and has spaced-apart forward and aft radially-extending arms 38 and 40, respectively, connected by a longitudinal member 41. The shroud hanger 34 may be a single continuous 360° component, or it may be segmented into two or more arcuate segments. An arcuate forward hook 42 extends axially aft from the forward arm 38, and an arcuate aft hook 44 extends axially aft from the aft arm 40.

Each shroud segment 32 includes an arcuate base 46 having radially outwardly extending forward and aft rails 48 and 50, respectively. A forward mounting flange 52 extends forwardly from the forward rail 48 of each shroud segment 32, and an aft mounting flange 54 extends rearwardly from the aft rail 50 of each shroud segment 32. The shroud segment 32 may be formed as a one-piece casting of a suitable superalloy, such as a nickel-based superalloy, which has acceptable strength at the elevated temperatures of operation in a gas turbine engine. The forward mounting flange 52 engages the forward hook 42 of the shroud hanger 34. The aft mounting flange 54 of each shroud segment 32 is juxtaposed with the aft hook 44 of the shroud hanger 34 and is held in place by a plurality of retaining members commonly referred to as "C-clips" 56.

The C-clips 56 are arcuate members each having a C-shaped cross section with inner and outer arms 58 and 60, respectively, that snugly overlap the aft mounting flanges 54 and the aft hooks 44 so as to clamp the aft ends of the shroud segments 32 in place against the shroud hangers 34. The inner and outer arms are joined by an arcuate, radially-extending flange 57. Although they could be formed as a single continuous ring, the C-clips 56 are typically segmented to accommodate thermal expansion. Typically, each C-clip 56 clamps an at least one shroud segment.

Figure 3:
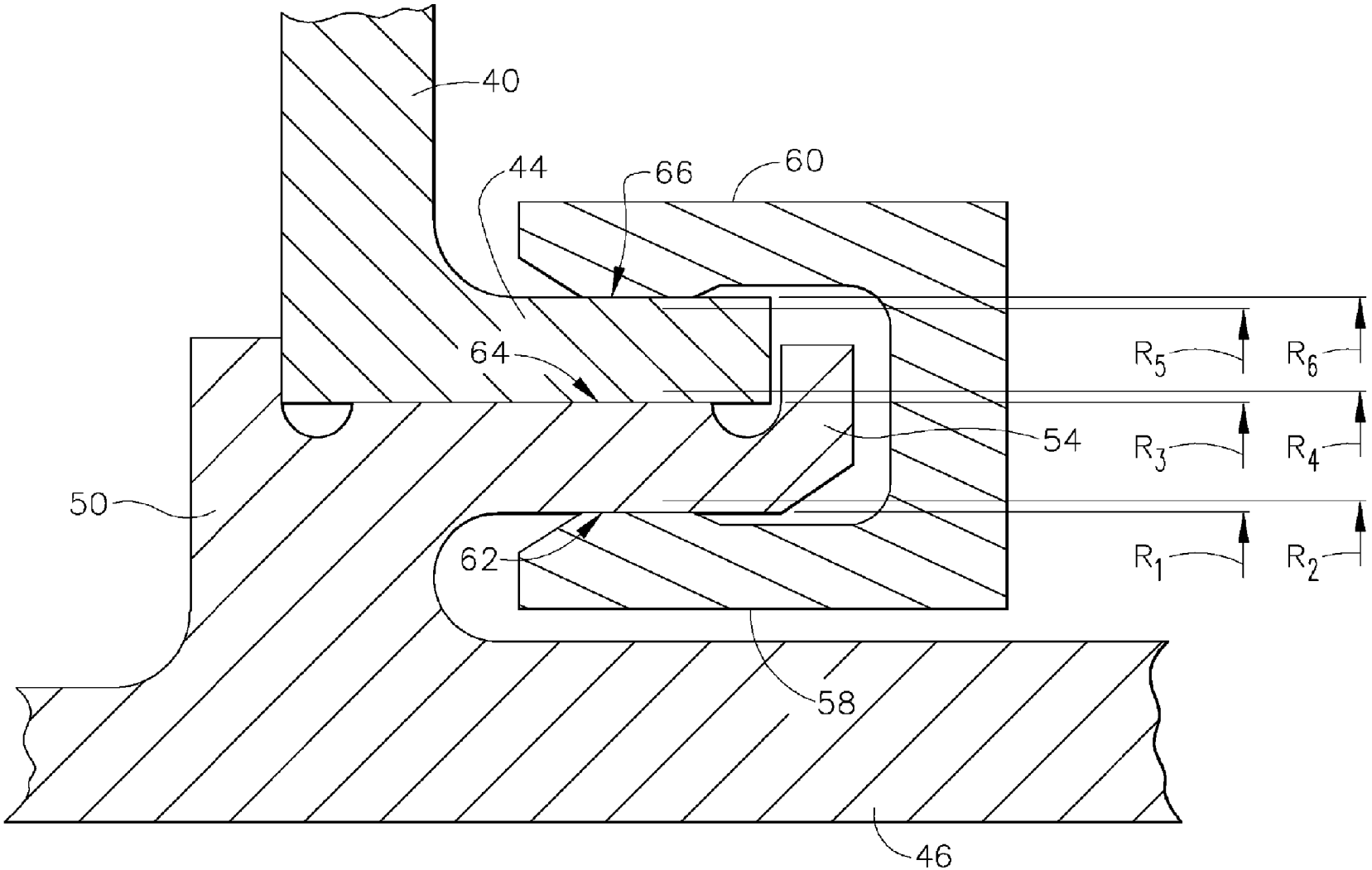
FIG. 3 is an enlarged cross-sectional view of a portion of FIG. 2.

FIG. 3 is an enlarged view of the aft portion of the shroud segment 32, showing the radii of various components. "R1" is the outside radius of the inner arm 58 of the C-clip 56. "R2" is the inside radius of the aft mounting flange 54 of the shroud segment 32, and "R3" is its outside radius. "R4" is the inside radius of the aft hook 44 of the shroud hanger 34, and "R5" is its outside radius. Finally, "R6" is the inside radius of the outer arm 60 of the C-clip 56. These radii define interfaces 62, 64, and 66 between the various components. For example, the radii "R1" of the lower C-clip arm 58 and "R2" of the aft mounting flange 54 meet at the interface 62.

Figure 4A:
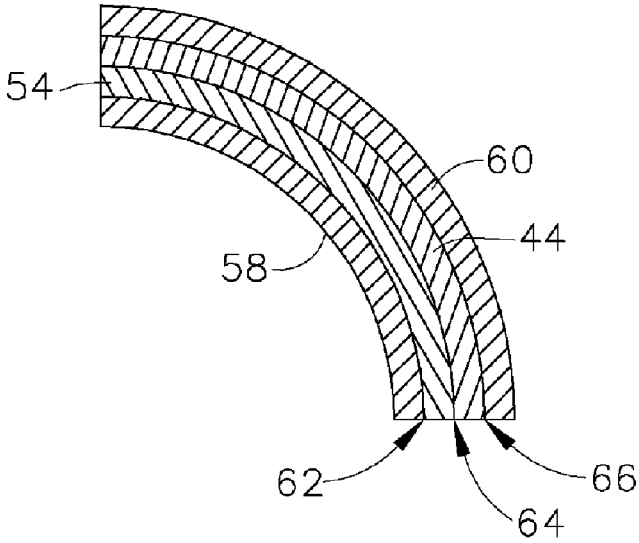
FIG. 4A (PRIOR ART)
FIG. 4A is partial cross-sectional view taken along lines 4-4 of FIG. 2.

FIG. 4A shows the circumferential relationship of the curvatures of these interfaces 62, 64, and 66 at a cold (i.e. room temperature) assembly condition. The curvatures are designed to result in a preselected dimensional relationship at this condition. The term "preselected dimensional relationship" as used herein means that a particular intended relationship between components applies more or less consistently at the interface, whether that relationship be a specified radial gap, a "matched interface" where the gap between components is nominally zero, or a specified amount of radial interference. For example, in FIG. 4A, there is a preselected amount of radial interference at each point around the circumference of the interfaces 62 and 66, in order to provide a predetermined clamping force to the aft mounting flange 54 and the aft hook 44, in accordance with known engineering principles. The interface 64 is a "matched interface" in that radius R3 is equal to radius R4. It should be noted that the term "curvature" is used to refer to deviation from a straight line, and that the magnitude of curvature is inversely proportional to the circular radius of a component or feature thereof.

Figure 4B:
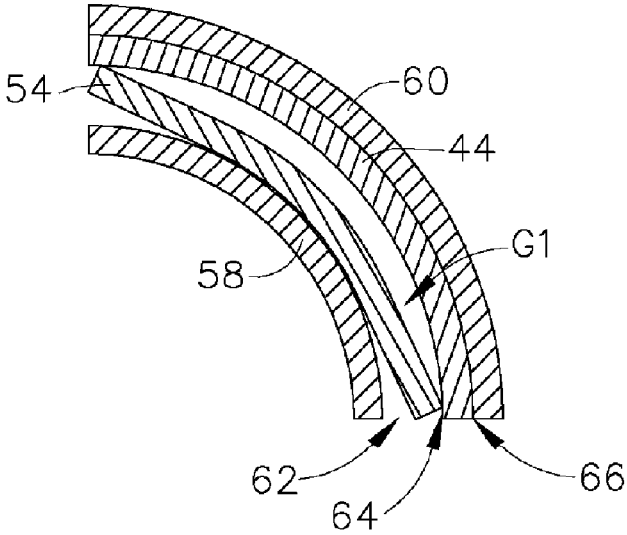
FIG. 4B (PRIOR ART)
FIG. 4B is partial cross-sectional view taken along lines 4-4 of FIG. 2.

FIG. 4B illustrates the changes of the interfaces 62, 64, and 66 from a cold assembly condition to a hot engine operation condition. At operating temperatures, for example bulk material temperatures of about 538° C. (1000° F.) to about 982° C. (1800° F.), all of the shroud segment 32, shroud hanger 34, and C-clip 56 will heat up and expand according to their own temperature responses. Because the shroud temperature is much hotter than the hanger temperature and the shroud segment 32 is much smaller than the hanger segment or ring, the curvature of the shroud segment 32 will expand more and differently from the hanger curvature at the interface 64 under steady state, hot temperature operation conditions. In addition, there is more thermal gradient within the shroud segment 32 than in the shroud hanger 34. As a result, the shroud segment 32 and its aft mounting flange 54 will tend to expand and increase its radius into a flattened shape (a phenomenon referred to as "cording") to a much greater degree than either the C-clip 56 or the aft hook 44. This causes a gap "G1" to be formed at the interface 64 between the shroud aft mounting flange outer radius and the shroud hanger aft hook inner radius. The gap G1 forces the C-clip 56 open and induces stress in the assembly. These stresses limit part life and increase risk of failure.

Figure 5:
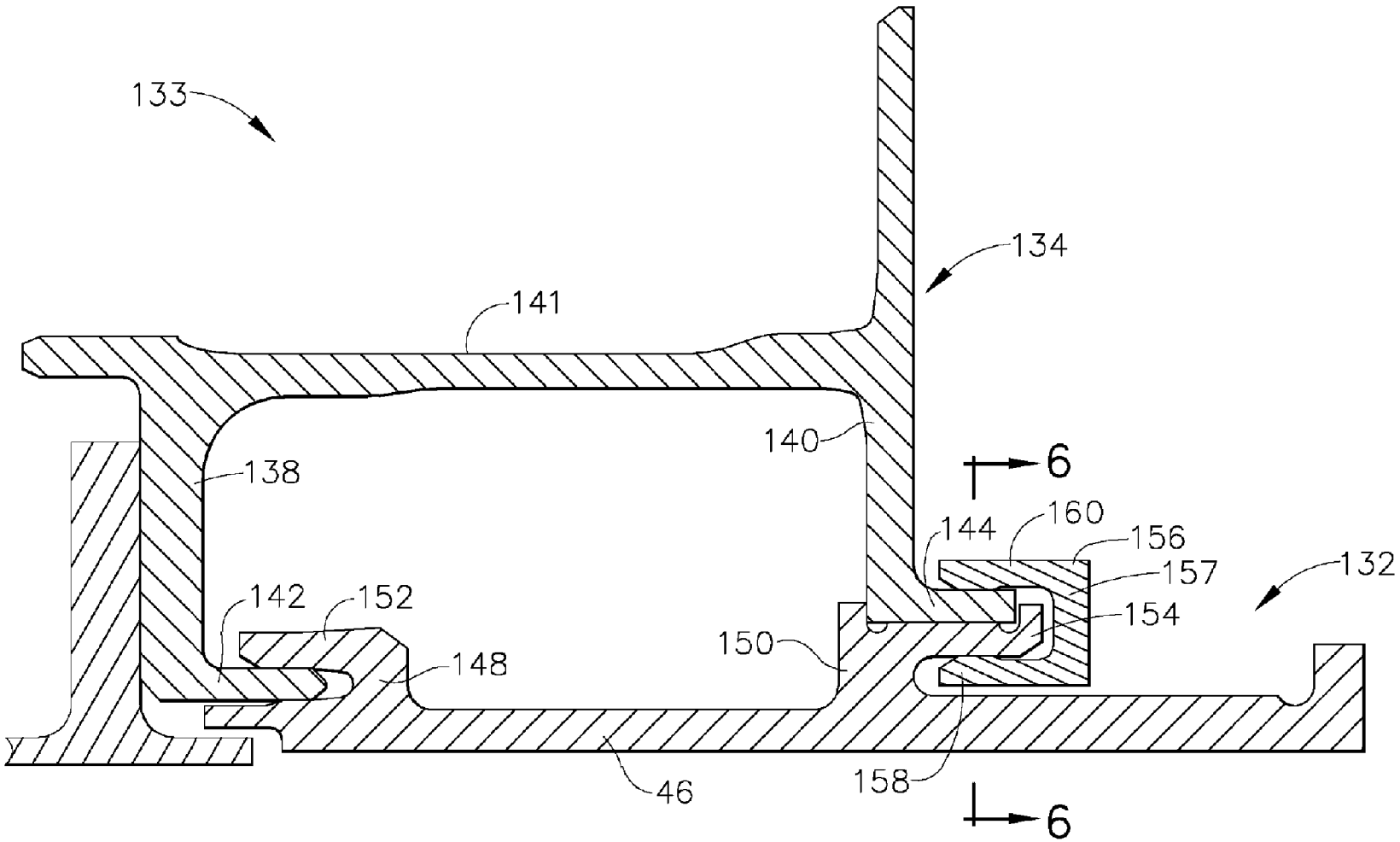
FIG. 5 is a cross-sectional view of a shroud assembly constructed according to the present invention.

FIG. 5 illustrates a shroud assembly 133 constructed according to the present invention. The shroud assembly 133 is substantially identical in most aspects to the prior art shroud assembly 33 and includes a "shroud hanger" 134 with spaced-apart forward and aft radially-extending arms 138 and 140, respectively, connected by a longitudinal member 141, and arcuate forward and aft hooks 142 and 144. A shroud segment 132 includes an arcuate base 146 with forward and aft rails 148 and 150, carrying forward and aft mounting flanges 152 and 154, respectively. The forward mounting flange 152 engages the forward hook 142 of the shroud hanger 134. The aft mounting flange 154 engages the aft hook 144. The shroud segment 132 is held in place by a plurality of "C-clips" 156 each having inner and outer arms 158 and 160, respectively, joined together by a flange 157.

Figure 6A:
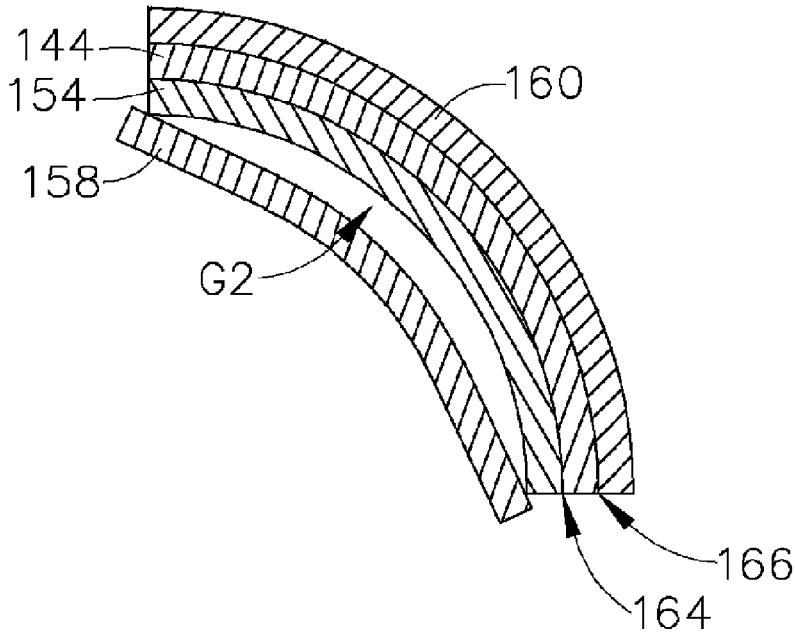
FIG. 6A is partial cross-sectional view taken along lines 6-6 of FIG. 5.

The shroud assembly 133 differs from the shroud assembly 33 primarily in the selection of certain dimensions of the C-clips 156 which affect the interfaces 162 and 166. FIG. 6A shows the relationship of the curvatures of the interfaces 162, 164, and 166 at a cold (i.e. ambient environmental temperature) assembly condition, also referred to as their "cold curvatures". The "hot" curvatures of the interfaces are selected to achieve a preselected dimensional relationship at the anticipated hot engine operating condition, meaning that they are intentionally "mismatched" or "corrected" at the cold assembly condition based on each component's thermal growth differences. Specifically, the curvature of at least the inner arm 158 of the C-clip 156 is made less than that of the inner surface of the shroud aft mounting flange 154, producing a gap "G2" in the interface 162 at the cold condition.

Figure 6B:
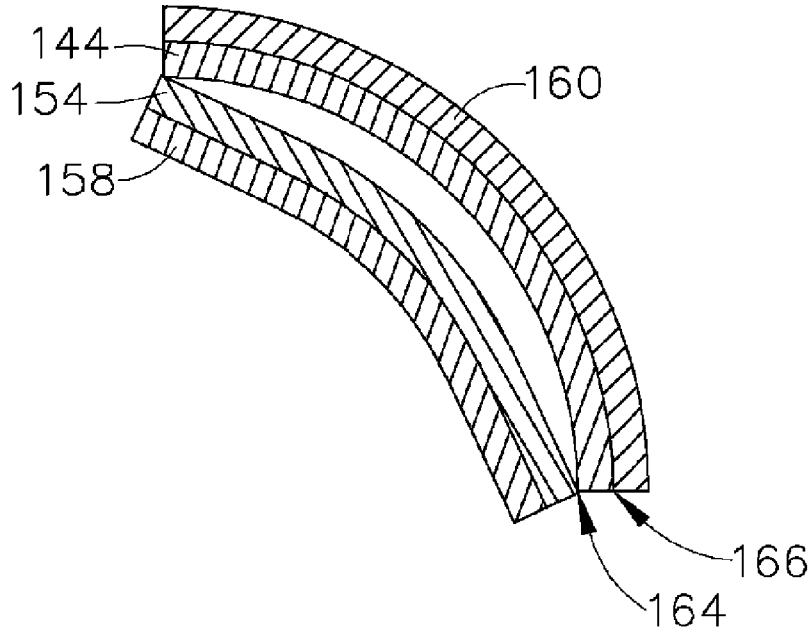
FIG. 6B is partial cross-sectional view taken along lines 6-6 of FIG. 5.

At operating temperatures, for example bulk material temperatures of about 538° C. (1000° F.) to about 982° C. (1800° F.), the shroud segment 132 and its aft mounting flange 154 will be hotter and expand more than the shroud hanger aft hook 144 or the inner and outer arms 158 and 160 of the C-clip 156, as shown in FIG. 6B. The provision of the gap "G2" at the cold assembly condition allows the aft mounting flange 154 to flatten out as it heats up without putting undue stress on the inner arm 158 of the C-clip 156.

The correction may be accomplished by different methods. In any case, a suitable means of modeling the high-temperature behavior of the shroud assembly 133 is used to simulate the dimensional changes in the components as they heat to the hot operating condition. The cold dimensions of the components are then set so that the appropriate "stack-up" or dimensional interrelationships will be obtained at the hot operating condition.

The desired hot stack-up may also be achieved through simple intentional mis-matching of components. For example, in the illustrated shroud assembly 133 having a shroud hanger 134 with "baseline" dimensions, the C-clip 156 may be a component which is intended for use with a different engine that has circular radii slightly larger than that component ordinarily would. For example, in a shroud assembly where the outside radius of the inner C-clip arm 158 is intended to be equal to the inside radius of the shroud aft mounting flange 154, and both of these dimensions are on the order of about 44.5 cm (17.5 inches) at a cold assembly condition, an increase of about 2 to about 3 inches in the outside radius of the C-clip inner arm 158 would be considered an optimum amount of "correction". This would theoretically allow the curvature of the inside radius of the aft mounting flange 154 to match that of the C-clip inner arm 158 at the hot operating condition. This result is what is depicted in FIG. 6B.

In actual practice, a balance must be struck between obtaining the preselected dimensional relationship to the desired degree at the hot operating condition, and managing the difficulty in assembly caused by component mismatch at the cold assembly condition. The component stresses must also be kept within acceptable limits at the cold assembly condition. In the illustrated example, the outside radius of the inner arm 158 is about 0.76 mm (0.030 in. ) to about 1.3 mm (0.050 in.) greater than this same dimension of the prior art C-clip 56.

Purpose-designed components may be used to effect the desired "correction". For example, the C-clip 156 may be constructed so that the curvature of its inner arm 158 is less than the curvature of its outer arm 160 and also less than the curvature of the shroud aft mounting flange 154, at the cold condition.

The configuration described above can substantially reduce or eliminate bending stress on both the C-clip 156 and the shroud mounting flange 154. It also allows for hotter operating conditions and larger thermal gradients in the shroud segment 132, since temperature will have minimal to no effect on shroud rail or C-clip stresses. This configuration can eliminate the need for plastic deformation in the C-clip 156 and allow for alternative materials.

The foregoing has described a C-clip and shroud assembly for a gas turbine engine. While specific embodiments of the present invention have been described, it will be apparent to those skilled in the art that various modifications thereto can be made without departing from the spirit and scope of the invention. For example, while the present invention is described above in detail with respect to a second stage shroud assembly, a similar structure could be incorporated into other parts of the turbine. Accordingly, the foregoing description of the preferred embodiment of the invention and the best mode for practicing the invention are provided for the purpose of illustration only and not for the purpose of limitation, the invention being defined by the claims.

What is claimed is:

1. A shroud assembly for a gas turbine engine having a temperature at a hot operating condition substantially greater than at a cold assembly condition thereof, said shroud assembly comprising:

at least one arcuate shroud segment adapted to surround a row of rotating turbine blades, said shroud segment having an arcuate, axially extending mounting flange;

a shroud hanger having an arcuate, axially-extending hook disposed in mating relationship to said mounting flange; and an arcuate C-clip having inner and outer arms overlapping said mounting flange and said hook respectively;

wherein the mating relationship is disposed at a medial location of said flange and said hook at the cold assembly condition, said mounting flange and the inner arm of said C-clip define a radial gap therebetween at the cold assembly condition, said shroud segment and said C-clip are subject to thermal expansion at said hot operating condition such that said shroud segment expands circumferentially thereby reducing the radial gap, and a dimension of said C-clip is selected to produce a preselected dimensional relationship between said shroud segment and said C-clip at said hot operating condition.

2. The shroud assembly of claim 1 wherein said preselected dimensional relationship comprises a preselected amount of radial interference between mating portions of said C-clip and said mounting flange.

3. The shroud assembly of claim 1 wherein said preselected dimensional relationship comprises a matched interface between mating portions of said mounting flange and said C-clip.

4. The shroud assembly of claim 1 wherein said mounting flange has a first radius of curvature; and at least one of said inner and outer arms of said C-clip has a second radius of curvature which is substantially greater than said first radius of curvature.

5. The shroud assembly of claim 4 wherein said inner and outer arms of said C-clip have second and third radii of curvature, each of which is substantially greater than said first radius of curvature.

6. A method of constructing a shroud assembly for a gas turbine engine comprising:

providing a shroud hanger having an arcuate, axially-extending hook;

providing at least one arcuate shroud segment adapted to surround a row of rotating turbine blades, said shroud segment having an arcuate, axially extending mounting flange having a first cold curvature at an ambient temperature, and a first hot curvature at an operating temperature substantially greater than said ambient temperature such that said shroud segment is expanded circumferentially at said first hot curvature, said mounting flange disposed in mating relationship at a medial location to said hook at least at the ambient temperature;

providing an arcuate C-clip having inner and outer arms overlapping said hook and said mounting flange, said C-clip having a second cold curvature at said ambient temperature and a second hot curvature at said operating temperature, said mounting flange and the inner arm of said C-clip defining a radial gap at the ambient temperature, selecting said first and second cold curvatures such that said first and second hot curvatures define a preselected dimensional relationship between said shroud segment and said C-clip.

7. The method of claim 6 wherein said preselected dimensional relationship comprises a matching interface between mating portions of said C-clip and said mounting flange.

8. The method of claim 6 wherein said hook has a first radius of curvature; and at least one of said inner and outer arms of said C-clip has a second radius of curvature which is substantially greater than said first radius of curvature.

9. The method of claim 8 wherein said inner and outer arms of said C-clip have second and third radii of curvature, each of which is substantially greater than said first radius of curvature.

* * * * *